US005545865A

United States Patent [19]

Gotou

[11] Patent Number: 5,545,865

[45] Date of Patent: Aug. 13, 1996

[54] PUSH-BUTTON SWITCH

[75] Inventor: Seiitirou Gotou, Tokyo, Japan

[73] Assignee: NEC Corporation, Tokyo, Japan

[21] Appl. No.: 208,825

[22] Filed: Mar. 11, 1994

[30] Foreign Application Priority Data

Mar. 15, 1993 [JP] Japan ..... 5-080193

[51] Int. Cl.[6] ..... H01H 3/12

[52] U.S. Cl. ..... 200/341; 200/345

[58] Field of Search ..... 200/341, 343, 200/344, 345, 520, 6 A, 339, 553, 302.3, 302.2

[56] References Cited

U.S. PATENT DOCUMENTS 4,417,113 11/1983 Saito et al. ..... 200/302.2

*Primary Examiner*—David J. Walczak

*Attorney, Agent, or Firm*—Whitham, Curtis, Whitham & McGinn

[57] ABSTRACT

A push-button switch capable of surely operating a switch element thereof and restoring an original position even when pressed at a corner thereof, while implementing a positive waterproof and dust-proof arrangement. A stub extends from the bottom of a push button and extends throughout an opening formed in a casing. The tip of the stub presses a switch element. A guide is fitted on the stub of the push button. When the push button is pressed at a corner thereof, the guide contacts the rear of the casing to form a fulcrum. As a result, the push button is caused to incline about the fulcrum.

4 Claims, 3 Drawing Sheets

PUSH-BUTTON SWITCH

BACKGROUND OF THE INVENTION

The present invention relates to a push-button switch feasible for various kinds of electronic apparatuses and, more particularly, to a push-button switch capable of surely operating a switch element thereof and restoring an original position even when pressed at a corner thereof, while having a waterproof and dust-proof arrangement.

Electronic apparatus are generally provided with push-button switches each implementing a particular purpose and each having a push button. When the push button of such a switch is pressed by the operator's finger, it brings contacts of the switch into connection. The problem with this kind of switch is that the operator is apt to press a corner portion of the push button around the expected central portion. Then, it is likely that the push button fails to operate the switch element correctly or even fails to restore the original position thereof. In addition, the conventional switch of the kind described cannot fully prevent water and dust from penetrating thereinto.

SUMMARY OF THE INVENTION

It is, therefore, an object of the present invention to provide a push-button switch capable of operating correctly and restoring the original position thereof even when pressed at a corner portion.

It is another object of the present invention to provide a push-button switch capable of fully intercepting water and dust otherwise penetrating thereinto.

A push-button switch of the present invention comprises a switch body, a push button having a stub for pressing the switch body at the tip thereof, a casing having an opening through which the stub is passed, and a guide member fitted on the stub such that when the push button is pressed at a corner thereof, the guide member contacts the rear of the casing to form a fulcrum, whereby the push button is inclined about the fulcrum.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 3:
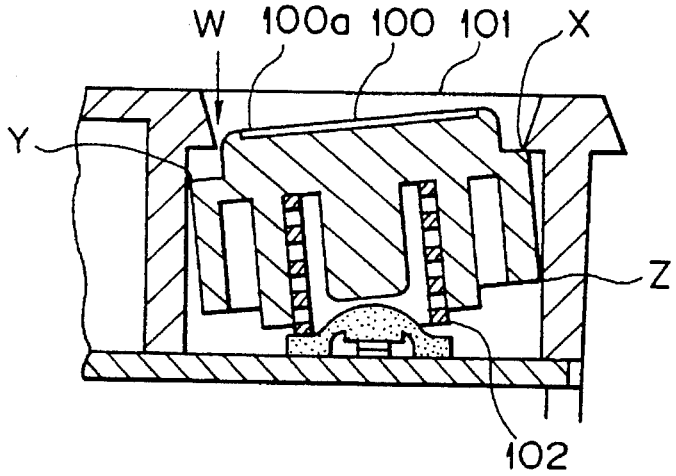
Fig. 3 PRIOR ART
FIG. 3 is a section showing a conventional push-button switch.

To better understand the present invention, a brief reference will be made to a conventional push-button switch, shown in FIG. 3. As shown, the switch has frame 101 and a push button 100 disposed in the frame 101. The push button 100 is tiltable about a contact point Z defined on the inner periphery of the frame 101. The problem with this configuration is that when the button 100 is tilted about the fulcrum Z excessively, it also contacts the frame 101 at two other points X and Y and fails to operate correctly or even fails to return to the original position thereof.

Figure 4:
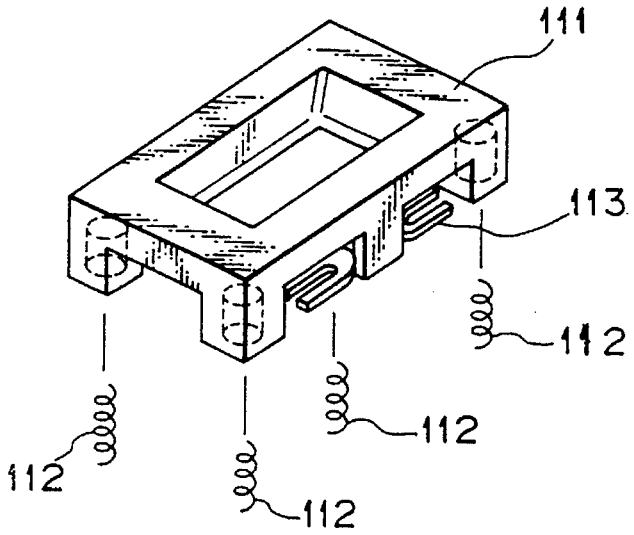
Fig. 4 PRIOR ART
FIG. 4 is a perspective view showing another conventional push-button switch.

Another conventional push-button switch is shown in FIG. 4 and disclosed in Japanese Patent Laid-Open Publication No. 1-197920. This switch is elaborated in consideration of the fact that when the push button 100 of FIG. 3 is brought into contact with the frame 101 at three points X, Y and Z, a return spring 102 cannot exert a sufficient returning force since it biases only the central part of the push button 100. As shown, the switch has a button base 111, return springs 112 fitted in four corners of the button base 111, and a plurality of parallel sets of movable contacts 113 positioned in the button base 111. Assume that a push button, not shown, is pressed at one corner thereof with the result that the button base 111 brought into contact with a fame, not shown, in an unusual way. Then, the return springs 112 effectively act on respective contact points to allow the push button to surely restore the original position thereof. However, even this kind of approach cannot obviate the excessive inclination of the push button which is the major cause preventing the push button from returning to the original position. Specifically, when the degree of the three-point contact of the push button with the frame overcomes the forces of the return springs 112, the push button cannot return. Should the preload of the return springs 112 be increased to eliminate this problem, the operator would be required to exert a greater force for operating the switch.

Figure 5:
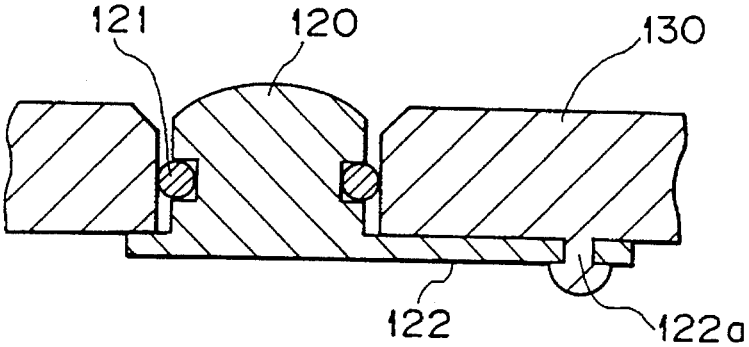
Fig. 5 PRIOR ART
FIG. 5 is a section showing still another conventional push-button switch.

FIG. 5 shows still another conventional push-button switch which includes measures against the penetration of water and dust as well as a measure against the above-stated occurrence. As shown, the switch has a push button 120, an O-ring 121 fitted on the side of the push button 120 to intercept water and dust, and a resilient rib 122 extending out from the bottom of the push button 120. In assembly, the push button 120 is inserted into an opening formed in a casing 130 from the inside of the casing 130, and then the end 122*a* of the rib 122 is affixed to the casing 130 by heat caulking or similar technology. In this configuration, the push button 120 inclines about the fixed end 122*a* thereof at all times without regard to the portion being pressed. This is successful in eliminating the excessive inclination of the push button 100, as discussed with reference to FIG. 3.

However, the switch shown in FIG. 5 has some problems left unsolved, as follows. The push button 120 is affixed to the casing 130 via the rib 122 extending from one end of the push button 120, as stated above. Hence, when the button 120 is pressed at a certain corner thereof, a great load acts on one end portion of the O-ring 121 while no noticeable load acts on the other end portion of the same. Such unbalanced compression locally increases the friction acting between the O-ring 121 and the casing 130. As a result, it is likely that the button 120 fails to restore the original position even when it is not inclined excessively. In addition, the unbalanced compression of the O-ring 121 prevents the ring 121 from sufficiently sealing the gap between the button 120 and the casing 130, degrading the waterproof and dust-proof effects.

Figure 1:
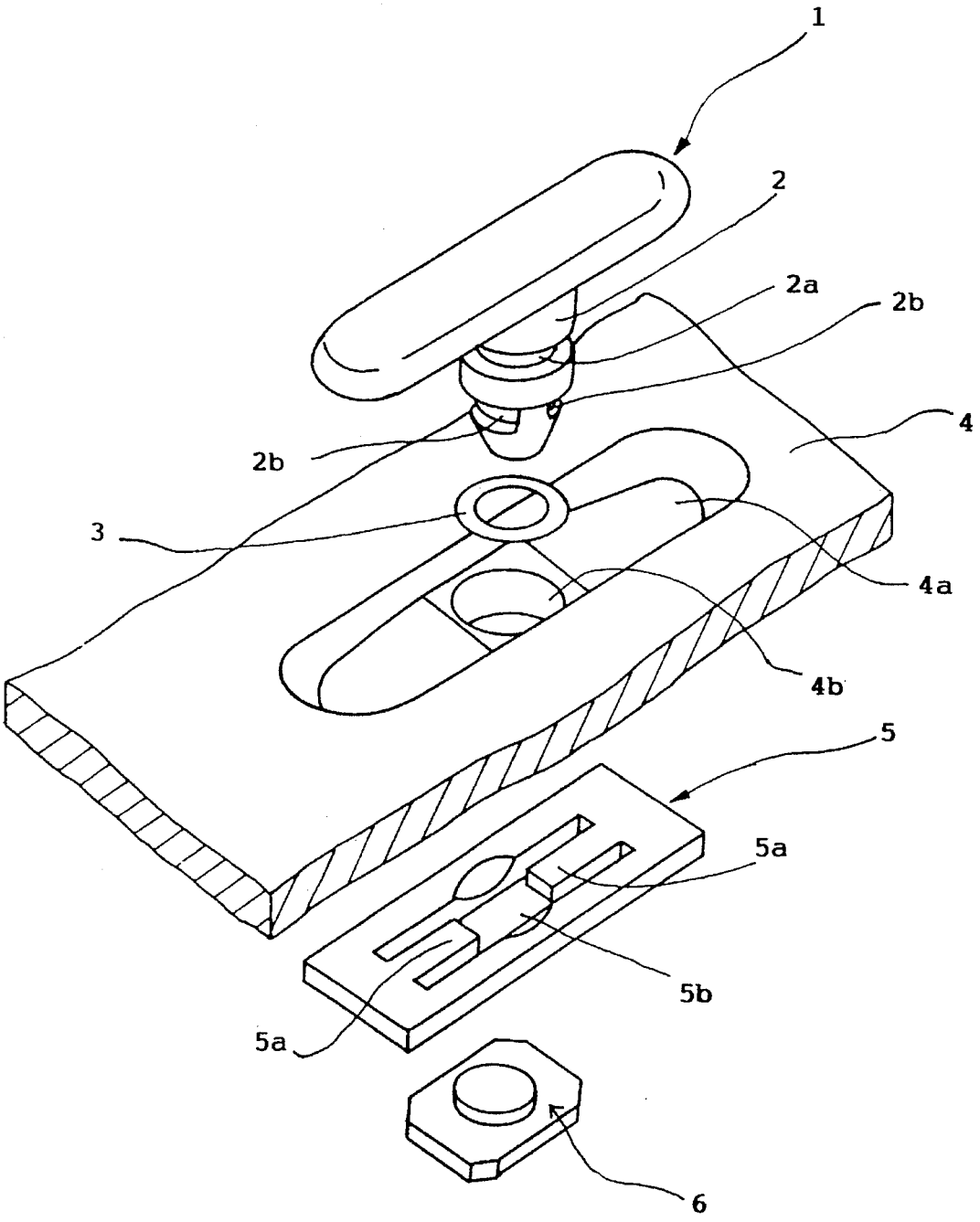
FIG. 1 is an exploded perspective view of a push-button switch embodying the present invention.

Referring to FIG. 1, a push-button switch embodying the present invention is shown in an exploded view. As shown, the switch has a push button 1 having an oblong shape. A stub 2 extends downward from the center of the underside of the push button 1 and is formed with an annular groove 2*a* and notches 2*b*. An O-ring 3 and a guide 5 are received in the groove 2*a* and the notches 2*b*, respectively, as will be described later. The tip of the stub 2 is tapered to facilitate the attachment of the O-ring 3 and guide 5. A casing 4, which will also be described later, is formed with an opening 4*b*. When the stub 2 is inserted into the opening 4*b* of the casing 4, the O-ring 3 received in the groove 2*a* seals the gap between the stub 2 and the casing 4.

A recess 4*a* is formed in the casing 4 and provided with a shape corresponding to that of the push button 1. The above-mentioned opening 4*b* is contiguous with the center of the recess 4*a*. The bottom of the recess 4*a* is inclined outward at opposite sides thereof, as illustrated. This allows the button 1 to be pressed deep enough to operate a switch element or push switch 6, which will be described, even when pressed at a certain corner thereof.

The guide 5 is implemented by a rectangular flat piece having substantially the same contour as the push button 1. The central part of the guide 5 is perforated generally in the form of a letter H to form a pair of resilient lugs 5*a* which face each other. A hole 5*b* is defined at the center of the H-shaped perforation, i.e., between the facing ends of the resilient lugs 5*a* in order to receive the stub 2. Opposite edges of the H-shaped perforation delimiting the hole 5*b* are rounded to facilitate the insertion of the stub 2. When the tip of the stub 2 is press-fitted in the hole 5*b* of the guide 5 via the opening 4*b* of the casing 4, the resilient lugs 5*a* of the guide 5 respectively snap into the notches 2*b* of the stub 2. As a result, the guide 5 is firmly affixed to the stub 2 in a position parallel to the push button 1.

The push switch 6 is provided with a spring thereinside and constantly biased thereby such that it urges the stub 2 of the push button 1 upward.

Figure 2A:
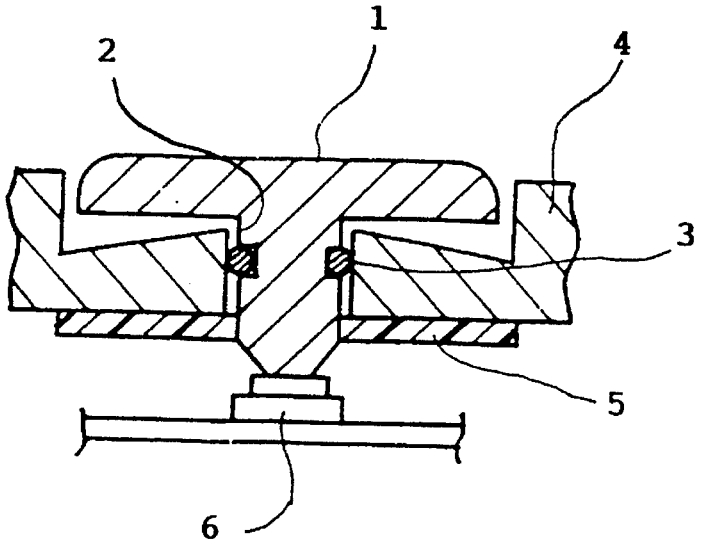
FIGS. 2A and 2B are sections showing the embodiment in a non-pressed condition and a pressed condition, respectively.
Figure 2B:
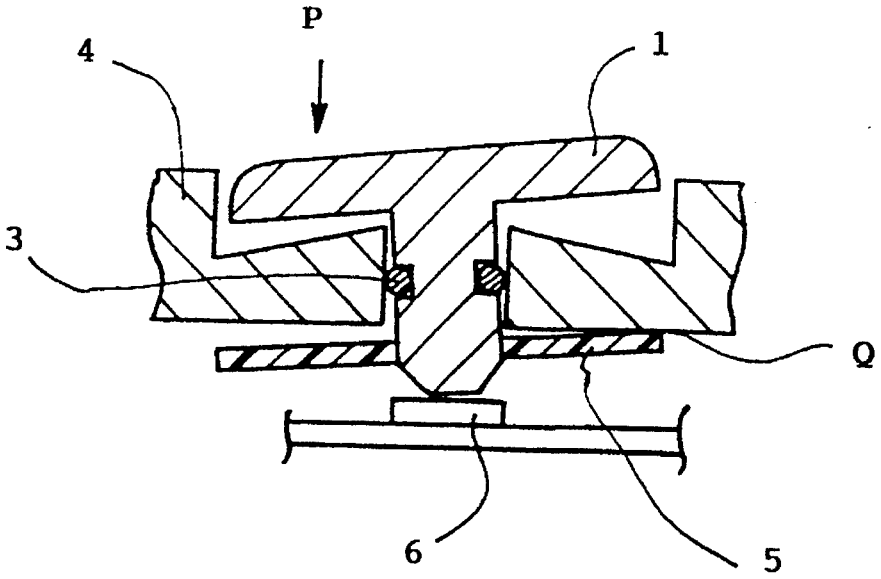

A reference will be made to FIGS. 2A and 2B for describing the operation of the embodiment. As shown in FIG. 2A, when the push button 1 is not pressed, the button 1 is raised by the push switch 6 via the stub 2 thereof. In this condition, the guide 5 is held in a horizontal position, contacting the underside of the casing 4 evenly. As shown in FIG. 2B, when the button 1 is pressed at one end thereof in a direction indicated by an arrow P in the figure, it inclines about a fulcrum Q, where the other end of the guide 5 and the rear of the casing 4 contact, and operates the push switch 6.

As stated above, when the push button 1 is pressed at a corner thereof, the guide 5 fitted on the stub 2 of the button 1 causes the button 1 to incline about the end of the guide 5. This prevents the end of the push button 1 from inclining excessively about the end thereof and, therefore, allows the button 1 to surely operate the push switch 6 and then restore the original position thereof.

Further, the guide 5 has a contour substantially matching that of the push button 1 and is fitted on the stub 2 in parallel to the button 1. In this condition, when any corner of the push button 1 is pressed, the guide 5 contacts the rear of the casing 4 to form a fulcrum. This, coupled with the fact that the guide 5 contacts the rear of the casing 4 easily only if any corner of the push button 1 is weakly pressed, prevents the button 1 from inclining excessively, whatever the manner in which the button 1 is pressed. Hence, the button 1 surely operates the push switch 6 and regains the original position thereof even when pressed at a corner thereof.

In the illustrative embodiment, the push button 1 is not directly affixed to the casing 4. In this condition, when the button 1 is pressed at a corner, the stub 2 moves in a certain direction with the result that a load acts on the 0-ring 3 evenly, by contrast to the conventional switch shown in FIG. 3. It follows that the O-ring 3 surely inhibits water and dust from penetrating into the assembly even when the button 1 is pressed at a corner. When the button 1 is not pressed, the guide 5 prevents the button 1 from slipping out of the switch assembly.

Various modifications will become possible for those skilled in the art after receiving the teachings of the present disclosure without departing from the scope thereof. For example, while the guide 5 has been shown and described as substantially corresponding in contour to the push button 1, the contour may be modified in various ways in conformity to the contour of the button 1 and the amount in which the button 1 should move when pressed at a corner. By changing the contour, or size, of the guide 5, it is possible to change the position of the fulcrum and the amount of pressing. If desired, the guide 5 may be provided with a rod- or frame-like configuration in place of the flat rectangular configuration shown and described. In the embodiment, the button 1 has a generally T-shaped section, including the center stub 2. However, the present invention is applicable to other various kinds of push-button switches, e.g., the conventional switch in which a spring or springs are positioned beneath a push button.

What is claimed is:

1. A push-button switch comprising:

a switch body;

a push-button having a head and a stub extending from said head for pressing said switch body at a tip thereof;

a casing having an opening through which said stud is passed, said head having a dimension such that an outer periphery of said head has a circumference greater than that of said opening;

a guide member fitted on said stub such that when said push button is pressed at a corner thereof, said guide member contacts a rear of said casing to form a fulcrum, whereby said push-button is inclined about said fulcrum; and a recess formed in said casing contiguously with said opening of said casing and corresponding in contour to said push button, said recess having a bottom inclined outward at opposite sides thereof, said push-button and said guide member being substantially symmetrical in shape for allowing said pressing of said switch body when downward pressure is applied to any part of said push-button.

2. A push-button switch comprising:

switch body;

push-button having a head and a stub extending from said head for pressing said switch body at a tip thereof;

a casing having an opening through which said stub is passed, said head having a dimension such that an outer periphery of said head has a circumference greater than that of said opening; and a guide member fitted on said stub such that when said push button is pressed at a corner thereof, said guide member contacts a rear of said casing to form a fulcrum, whereby said push-button is inclined about said fulcrum, said push-button and said guide member being substantially symmetrical in shape for allowing said pressing of said switch body when downward pressure is applied to any part of said push-button, said guide member being perforated at a center thereof to form a pair of lugs, and wherein said guide member is perforated to have an H-shaped form and wherein said pair of lugs face each other.

3. A push-button switch comprising:

a switch body;

a push-button having a head and a stub extending from said head for pressing said switch body at a tip thereof;

a casing having an opening through which said stub is passed, said head having a dimension such that an outer periphery of said head has a circumference greater than that of said opening;

a guide member fitted on said stub such that when said push button is pressed at a corner thereof, said guide member contacts a rear of said casing to form a fulcrum, whereby said push-button is inclined about said fulcrum; and a recess formed in said casing contiguously with said opening of said casing and corresponding in contour to said push button, said recess having a bottom inclined outwardly at opposite sides thereof and in a direction of pressing said push button downwardly away from said opening so as to prevent a contaminant from entering said opening, said push-button and said guide member being substantially symmetrical in shape for allowing said pressing of said switch body when downward pressure is applied to any part of said push-button.

4. A push-button switch comprising:

a switch body;

a push button having a stub for pressing said switch body at a tip thereof;

a casing having an opening through which said stub is passed; and a guide member fitted on said stub such that when said push button is pressed at a corner thereof, said guide member contacts a rear of said casing to form a fulcrum, whereby said push button is inclined about said fulcrum, said push-button and said guide member being substantially symmetrical in shape for allowing said pressing of said switch body when downward pressure is applied to any part of said push-button, said guide member including means for affixing said guide member to said stub, and wherein said affixing means comprises said guide member being perforated at a center thereof in a form of a letter H to form a pair of resilient lugs which face each other, and a hole for receiving said stub.

* * * * *